US011809097B2

(12) United States Patent
Shiodera et al.

(10) Patent No.: US 11,809,097 B2
(45) Date of Patent: Nov. 7, 2023

(54) POWDER CONVEYING DEVICE AND IMAGE FORMING APPARATUS INCORPORATING THE POWDER CONVEYING DEVICE

(71) Applicants: Kota Shiodera, Tokyo (JP); Kazuhiko Watanabe, Tokyo (JP)

(72) Inventors: Kota Shiodera, Tokyo (JP); Kazuhiko Watanabe, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/591,735

(22) Filed: Feb. 3, 2022

(65) Prior Publication Data

US 2022/0299909 A1 Sep. 22, 2022

(30) Foreign Application Priority Data

Mar. 19, 2021 (JP) ..... 2021-045701

(51) Int. Cl.
*G03G 15/08* (2006.01)
*G03G 21/10* (2006.01)
(Continued)

(52) U.S. Cl.
CPC ..... *G03G 15/0891* (2013.01); *G03G 15/095* (2013.01); *G03G 21/105* (2013.01);
(Continued)

(58) Field of Classification Search
CPC ..... G03G 15/0891; G03G 15/095; G03G 15/0879; G03G 15/1615; G03G 15/161;
(Continued)

(56) References Cited

U.S. PATENT DOCUMENTS 3,604,599 A * 9/1971 Richmond ..... G03G 15/0877 222/413
5,561,021 A * 10/1996 Yamazaki ..... G03G 5/08221 430/130

(Continued)

FOREIGN PATENT DOCUMENTS

JP 2003-091221 3/2003
JP 2005015148 A * 1/2005

(Continued)

*Primary Examiner* — Arlene Heredia
*Assistant Examiner* — Laura Roth
(74) *Attorney, Agent, or Firm* — P.L.C. Harness, Dickey & Pierce

(57) ABSTRACT

A powder conveying device includes an inflow portion, a discharge portion, and a conveying screw. Powder flows into the inflow portion from outside of the powder conveying device. The powder flows out from the discharge portion to the outside of the powder conveying device. The conveying screw includes a shaft and conveys the powder from the inflow portion to the discharge portion in a conveying direction. A surface portion of the shaft at at least one of an upstream end or a downstream end of the shaft in the conveying direction, in at least one of the inflow portion or the discharge portion has a lower friction with the powder than another surface portion of the shaft at a position other than the at least one of the upstream end or the downstream end.

9 Claims, 6 Drawing Sheets

(51) Int. Cl.
*G03G 15/095* (2006.01)
*G03G 15/16* (2006.01)

(52) U.S. Cl.
CPC . *G03G 15/1615* (2013.01); *G03G 2215/0827* (2013.01); *G03G 2215/1661* (2013.01); *G03G 2221/1624* (2013.01)

(58) Field of Classification Search
CPC ..... G03G 21/105; G03G 2215/0827; G03G 2215/1661; G03G 2221/1624
See application file for complete search history.

(56) References Cited

U.S. PATENT DOCUMENTS 8,306,469 B2 * 11/2012 Kimura ..... G03G 15/161 399/350
2004/0213600 A1 10/2004 Watanabe et al.
2005/0100375 A1 5/2005 Naruse et al.
2005/0196193 A1 9/2005 Tamoto et al.
2006/0086592 A1 * 4/2006 Olds ..... B65G 33/20 198/658
2006/0204259 A1 9/2006 Watanabe et al.
2007/0242992 A1 10/2007 Watanabe et al.
2008/0063448 A1 3/2008 Hozumi et al.
2008/0260431 A1 * 10/2008 Saito ..... G03G 15/0877 399/256
2009/0123205 A1 5/2009 Watanabe et al.
2011/0229186 A1 9/2011 Okamoto et al.
2011/0229188 A1 9/2011 Watanabe et al.
2011/0229233 A1 9/2011 Watanabe et al.
2012/0261236 A1 * 10/2012 Farrell ..... B65G 33/14 29/525.01
2013/0216288 A1 * 8/2013 Murata ..... G03G 21/105 399/358
2014/0119769 A1 5/2014 Kikuchi et al.
2014/0161501 A1 6/2014 Watanabe et al.
2015/0301496 A1 * 10/2015 Kawashima ..... G03G 21/105 399/358
2018/0275562 A1 * 9/2018 Nemoto ..... G03G 15/0891
2018/0341200 A1 11/2018 Ohsugi
2021/0034010 A1 2/2021 Watanabe et al.
2021/0216032 A1 7/2021 Watanabe et al.
2021/0325802 A1 10/2021 Kumagai et al.

FOREIGN PATENT DOCUMENTS

JP 2010281927 A * 12/2010
JP 2015-060169 3/2015
JP 2015-215511 12/2015
JP 2018-200334 12/2018

* cited by examiner

POWDER CONVEYING DEVICE AND IMAGE FORMING APPARATUS INCORPORATING THE POWDER CONVEYING DEVICE

CROSS-REFERENCE TO RELATED APPLICATION

This patent application is based on and claims priority pursuant to 35 U.S.C. § 119(a) to Japanese Patent Application No. 2021-045701, filed on Mar. 19, 2021, in the Japan Patent Office, the entire disclosure of which is hereby incorporated by reference herein.

BACKGROUND

Technical Field

Embodiments of the present disclosure relate to a powder conveying device and an image forming apparatus incorporating the powder conveying device.

Related Art

In the related art, a powder conveying device is known that includes a conveying screw. For example, a powder conveying device is used in an image forming apparatus to convey waste toner removed from a belt member by a cleaning member.

SUMMARY

In an embodiment of the present disclosure, there is provided a powder conveying device that includes an inflow portion, a discharge portion, and a conveying screw. Powder flows into the inflow portion from outside of the powder conveying device. The powder flows out from the discharge portion to the outside of the powder conveying device. The conveying screw includes a shaft and conveys the powder from the inflow portion to the discharge portion in a conveying direction. A surface portion of the shaft at at least one of an upstream end or a downstream end of the shaft in the conveying direction, in at least one of the inflow portion or the discharge portion has a lower friction with the powder than another surface portion of the shaft at a position other than the at least one of the upstream end or the downstream end.

In another embodiment of the present disclosure, there is provided an image forming apparatus that includes the powder conveying device.

In still another embodiment of the present disclosure, there is provided a powder conveying device that includes a conveying screw. The conveying screw includes a shaft and conveys powder in a conveying direction. At least one of a fluorine compound and a silicone-based compound is on a surface portion of at least a part of the shaft in the conveying direction.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
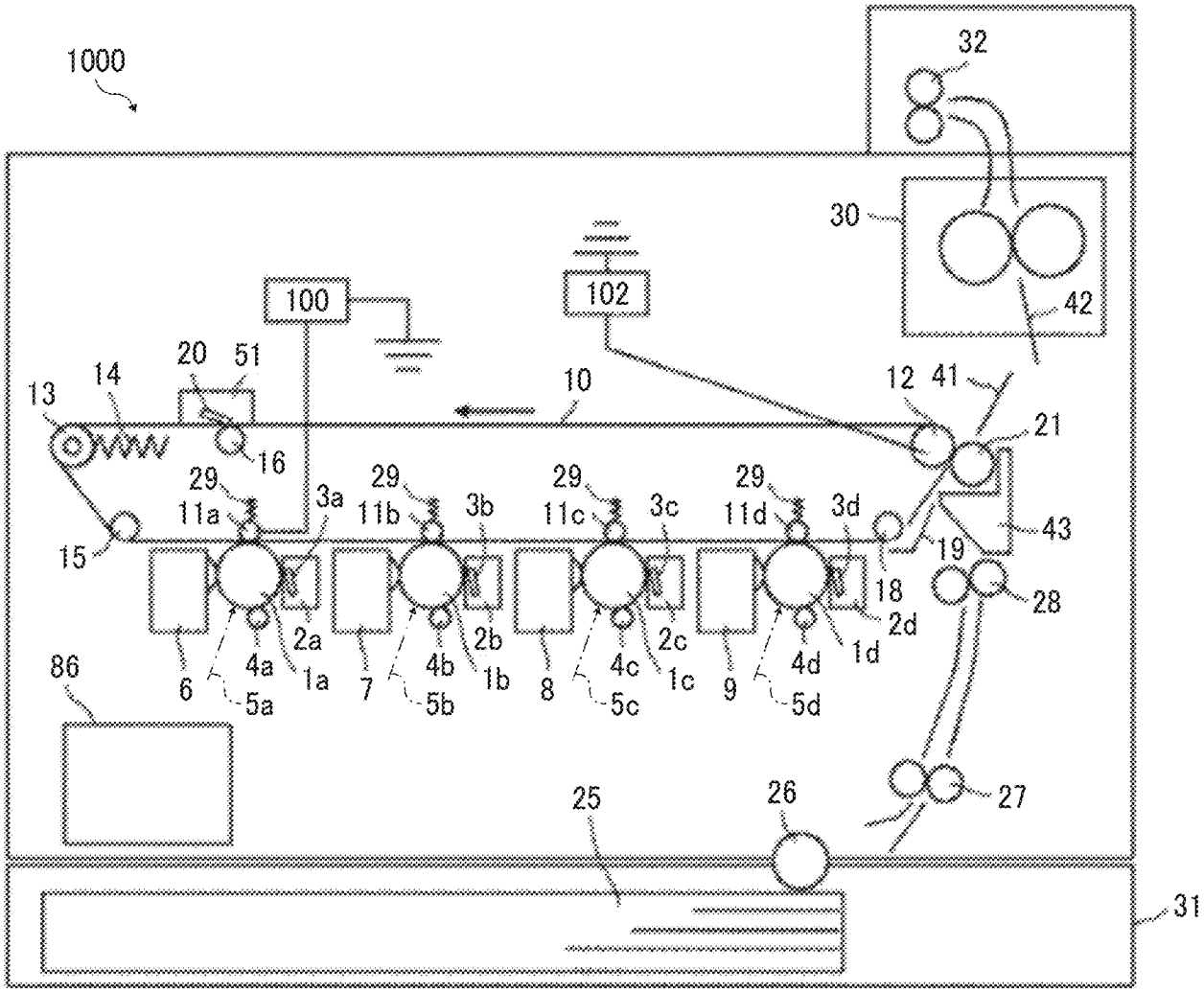
FIG. 1 is a schematic view of a color image forming apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

A description is given of a waste toner conveying device of an image forming apparatus according to an embodiment of the present disclosure. FIG. 1 is a schematic view of a color image forming apparatus according to an embodiment of the present disclosure. A color image forming apparatus 1000 according to the present disclosure is a tandem image forming apparatus in which four image forming devices of yellow, magenta, cyan, and black are arranged side by side along a belt moving direction below an intermediate transfer belt 10. In full-color image formation, visible images are formed in the order of a yellow developing device 6, a magenta developing device 7, a cyan developing device 8, and a black developing device 9. The visible images of four colors of yellow, magenta, cyan, and black are primarily transferred on the intermediate transfer belt 10 to form full-color images.

In FIG. 1, "a" is used as a code corresponding to yellow, "b" is used as a code corresponding to magenta, "c" is used as a code corresponding to cyan, and "d" is used as a code corresponding to black. Since the devices of four colors are configured in the same manner, the notations of "a", "b", "c", and "d" are omitted below as appropriate.

Each image forming device charges the surface of a photoconductor 1 as an image bearer by a charging device 4 and forms an electrostatic latent image by an exposure device 5. Each of the developing devices 6, 7, 8 and 9 develops the electrostatic latent image on the corresponding photoconductor 1 into a toner image. Powder is used as the toner. A primary transfer roller 11 as a primary transfer device transfers the toner image on the intermediate transfer belt 10 facing the photoconductor 1. A photoconductor cleaning device 2 collects untransferred toner on the photoconductor 1 by a photoconductor cleaning blade 3. The collected untransferred toner is stored in a waste toner container 86.

The intermediate transfer belt 10 is stretched by a secondary transfer counter roller 12, a tension roller 13 biased by a spring 14, and support rollers 15 and 18, and can rotate counterclockwise in FIG. 1. Specifically, as illustrated in FIG. 2, a drive motor 80 is connected to the secondary transfer counter roller 12, and a controller 90 that controls the drive motor 80 is connected to the drive motor 80. Accordingly, the secondary transfer counter roller 12 is driven by a driving force from the drive motor 80. The primary transfer roller 11 is disposed at a contact portion between the photoconductor 1 and the intermediate transfer belt 10. The primary transfer roller 11 is disposed inside the intermediate transfer belt 10 and pressed by a spring 29. A predetermined primary transfer bias is applied to the primary transfer roller 11 by each voltage applying device 100.

The image forming apparatus 1000 includes a belt cleaning unit 51 to clean the intermediate transfer belt 10. The belt cleaning unit 51 is described later with reference to FIG. 2.

A secondary transfer roller 21 contacts and is pressed against the secondary transfer counter roller 12 and rotates with the secondary transfer counter roller 12. A secondary transfer bias is applied to the secondary transfer counter roller 12 by a voltage applying device 102. The toner image on the intermediate transfer belt 10 is secondarily transferred onto a recording medium 25 at a secondary transfer position located at a nip portion between the secondary transfer roller 21 and the secondary transfer counter roller 12.

A fixing device 30 that fixes the image secondarily transferred onto the recording medium 25 is disposed above the secondary transfer roller 21. The fixing device 30 includes a fixing roller and a pressure roller. The pressure roller presses the fixing roller.

An operation of the image forming apparatus 1000 configured in this way is as described below. When a user presses a start switch of the image forming apparatus 1000, the drive motor 80 (see FIG. 2) is driven by a signal from a controller 90 to rotate the secondary transfer counter roller 12. Accordingly, the other rollers are driven to rotate, thus rotating the intermediate transfer belt 10 for conveyance. Meanwhile, in each image forming device, single-color images of yellow, magenta, cyan, and black are formed on photoconductors 1*a*, 1*b*, 1*c*, and 1*d*, respectively. A primary transfer bias is applied to the primary transfer roller 11 while the controller 90 of the image forming apparatus 1000 causes the drive motor 80 to drive the intermediate transfer belt 10. The respective single-color images are sequentially transferred onto the surface of the intermediate transfer belt 10 to form a composite color image on the surface of the intermediate transfer belt 10.

On the other hand, when the user presses the start switch, the controller 90 of the image forming apparatus 1000 causes a feed roller 26 of a sheet feeder 31 to rotate and feed the recording medium 25 from a sheet tray. The controller 90 of the image forming apparatus 1000 causes a separation roller to separate the recording medium 25 one by one and guide the recording medium 25 to a feeding path, causes a conveying roller pair 27 to convey and guide the recording medium 25 to the feeding path in the apparatus body, and causes a registration roller pair 28 to stop a leading end of the recording medium 25.

The controller 90 of the image forming apparatus 1000 causes the registration roller pair 28 to rotate in synchronization with movement of the composite color image formed on the intermediate transfer belt 10 to feed the recording medium 25 between the intermediate transfer belt 10 and the secondary transfer roller 21. Thus, the color image is transferred on the recording medium 25 by the secondary transfer roller 21. In this case, a counter transfer entrance guide 43 is disposed so that the recording medium 25 is conveyed along a transfer entrance guide 19. The secondary transfer bias may be applied to the secondary transfer roller 21 or the secondary transfer counter roller 12 as a secondary transfer device.

A four-color superimposed image transferred on the recording medium 25 at the nip portion between the secondary transfer roller 21 and the secondary transfer counter roller 12 is guided to a secondary transfer exit guide 41 and a fixing entrance guide 42 by the secondary transfer roller 21 and conveyed to the fixing device 30. The transferred image is fixed on the recording medium 25 by applying heat and pressure with an action of a fixing roller and a pressure roller of the fixing device 30. Thereafter, the recording medium 25 is ejected by an ejection roller pair 32.

On the other hand, residual toner remaining on the intermediate transfer belt 10 after image transfer is removed by the belt cleaning unit 51, and the intermediate transfer belt 10 is ready for the next image formation by the tandem image forming apparatus 1000.

Figure 2A:
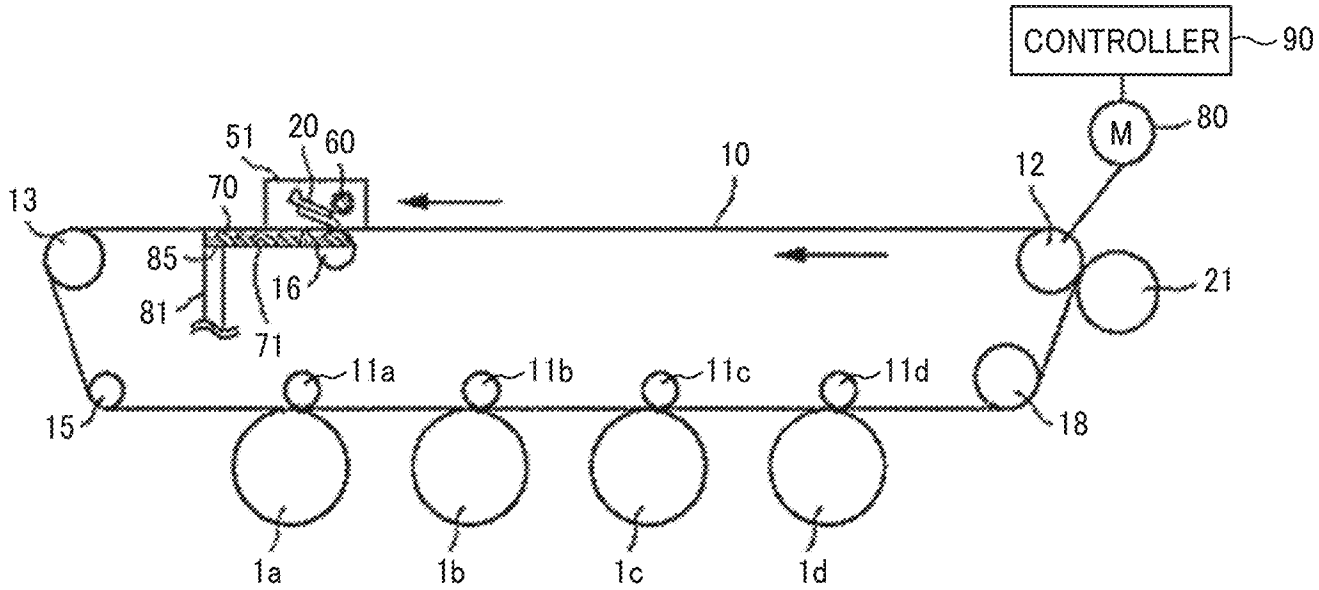
FIG. 2A is a cross-sectional view of a belt cleaning unit viewed from a front side of the image forming apparatus of FIG. 1.
Figure 2B:
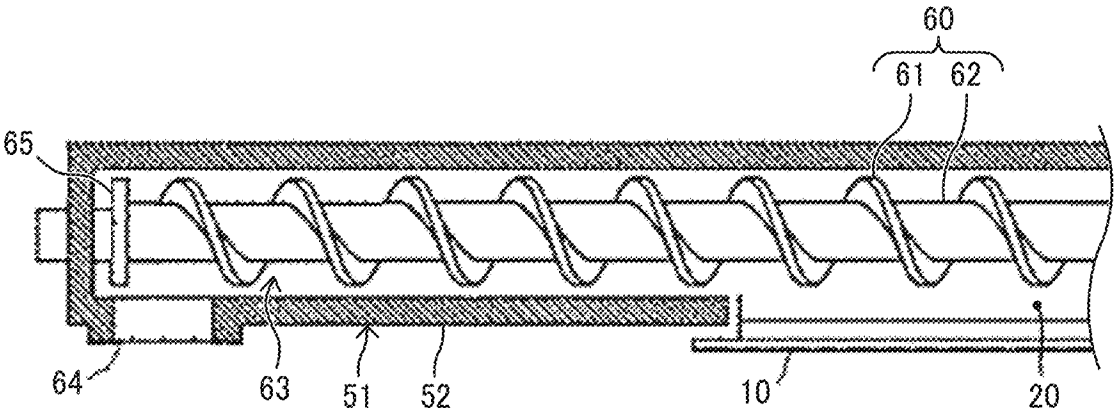
FIG. 2B is a cross-sectional view of the belt cleaning unit viewed from a direction indicated by an arrow in FIG. 1.
Figure 2C:
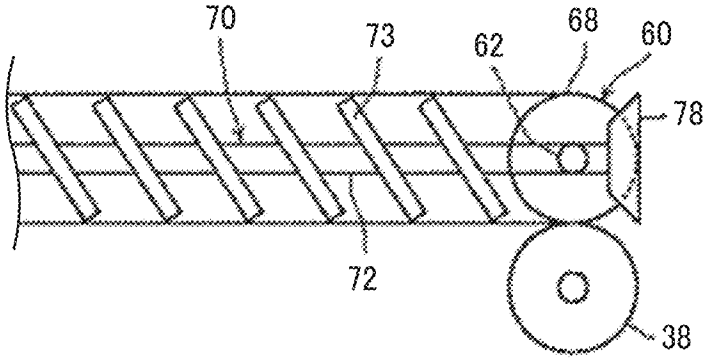
FIG. 2C is a schematic diagram illustrating a driving force transmission section of the belt cleaning unit and a waste toner conveying unit.

FIGS. 2A, 2B, and 2C are cross-sectional views of the belt cleaning unit. FIG. 2A is a cross-sectional view of the belt cleaning unit 51 viewed from a front side of the image forming apparatus of FIG. 1. FIG. 2B is a cross-sectional view of the belt cleaning unit viewed from a direction indicated by an arrow in FIG. 1. FIG. 2C is a schematic diagram illustrating a driving force transmission section of the belt cleaning unit and a waste toner conveying unit.

The belt cleaning unit 51 is a cleaning device that removes toner remaining on the intermediate transfer belt 10 as an image bearer after image transfer. The belt cleaning unit 51 is a component of a toner conveying device according to an embodiment of the present disclosure. As illustrated in FIG. 2B, the belt cleaning unit 51 includes a belt cleaning blade and a conveying screw 60 in a housing 52. The belt cleaning blade 20 as a cleaner is made of urethane rubber. The conveying screw 60 conveys the toner removed by the belt cleaning blade 20. The conveying screw 60 includes a cylindrical shaft 62 and a blade 61. The blade 61 is a spiral projection that radially protrudes outward from the shaft 62.

In FIG. 2A, the toner removed from the intermediate transfer belt 10 by the belt cleaning blade 20 is dropped into a waste toner conveying unit 71 disposed below the belt cleaning unit 51 by a rotation of the conveying screw 60. Thereafter, the toner falls from an opening portion 85 as a discharge portion of the waste toner conveying unit 71 and enters a duct 81. Thus, the toner is housed in the waste toner container 86 (see FIG. 1), which is disposed below the image forming apparatus 1000, with which the duct 81 communicates. An opposing roller 16 is disposed on an inner circumferential surface of the intermediate transfer belt 10 opposite the belt cleaning blade 20 to enhance adhesion between the belt cleaning blade 20 and the intermediate transfer belt 10.

As illustrated in FIG. 2B, the conveying screw 60 extends beyond the width in the left-right direction of the intermediate transfer belt 10 and the belt cleaning blade 20. The waste toner removed from the intermediate transfer belt 10 by the belt cleaning blade 20 is conveyed to the left side in FIG. 2B through a conveyance path 63 in the belt cleaning unit 51 by the conveying screw 60 that is driven rotationally. That is, the belt cleaning unit 51 functions as a toner conveying device in terms of conveying waste toner through the conveyance path 63 by the conveying screw 60. Thereafter, the waste toner freely falls from an opening portion 64 of the conveyance path 63 and is delivered to the waste toner conveying unit 71 disposed below the belt cleaning unit 51 as illustrated in FIG. 2A. Thus, the waste toner is conveyed further downstream by a conveying screw 70 in the waste toner conveying unit 71.

As described above, the intermediate transfer belt 10 is rotationally driven by the secondary transfer counter roller 12 to which the driving force from the drive motor 80 is transmitted. The opposing roller 16 is driven by a contact friction with the intermediate transfer belt 10 and rotated with the intermediate transfer belt 10.

On the other hand, as illustrated in FIG. 2C, a gear 68 is disposed at one end of the shaft 62 of the conveying screw 60, and the gear 68 meshes with a gear 38 disposed at one end of the opposing roller 16 that is rotated with the intermediate transfer belt 10. Accordingly, the conveying screw 60 receives a driving force from the opposing roller 16. A gear 78 is disposed at one end of a shaft 79 of the conveying screw 70 and meshes with the gear 68. Accordingly, the conveying screw 70 receives a driving force from the gear 68 of the conveying screw 60.

In this configuration, the controller 90 rotates the secondary transfer counter roller 12 in reverse by the drive motor 80 after the print job is completed. The controller 90 rotates the intermediate transfer belt 10 in reverse by, for example, 2 mm, so that the removed toner accumulated on the belt cleaning blade 20 is once discharged upstream from the belt cleaning blade 20. Accordingly, a failure that the removed toner accumulates at a specific area of the belt cleaning blade 20 or passes through the belt cleaning blade 20 can be prevented.

Figure 3A:
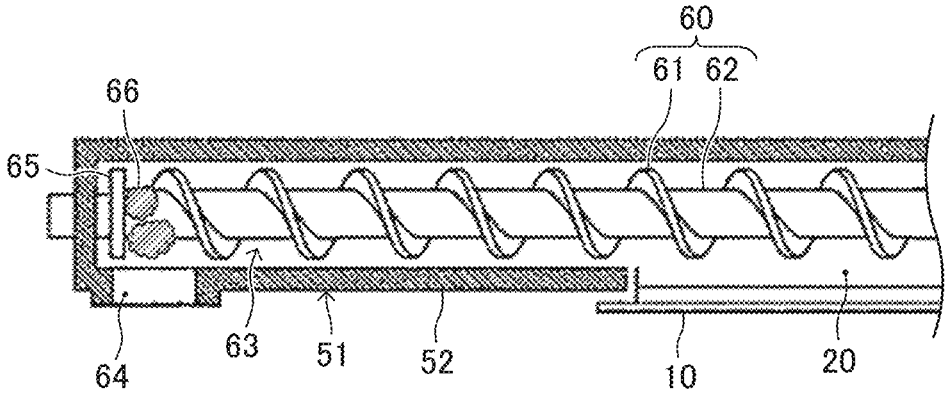
FIG. 3A is a schematic diagram illustrating waste toner stuck on a shaft of a screw.
Figure 3B:
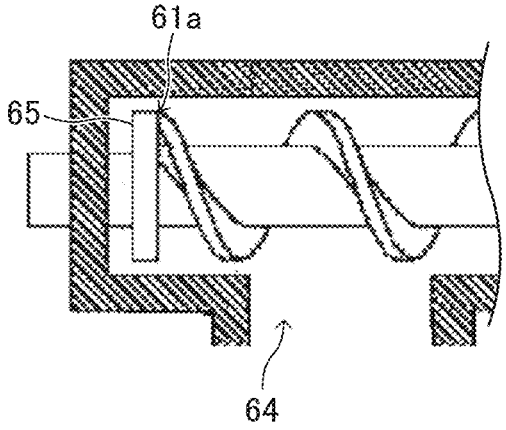
FIG. 3B is a schematic diagram illustrating a configuration of the shaft of the screw in the vicinity of an area where waste toner is stuck.

FIGS. 3A and 3B are cross sectional views of the belt cleaning unit 51 that corresponds to FIG. 2B. FIG. 3A is a schematic diagram illustrating waste toner stuck on a shaft of a screw. FIG. 3B is a schematic diagram illustrating a configuration of the shaft of the screw in the vicinity of an area where the waste toner is stuck. FIG. 3A illustrates a state in which waste toner 66 has adhered to a portion between the blade 61 and an inner surface of a disk-shaped flange member 65 as a member having a surface perpendicular to a shaft portion of the shaft 62. in a portion at which the conveying screw 60 faces the opening portion 64. At this portion, aggregation, adhesion, or cross linkage of toner is likely to occur. The toner does not fall freely toward the opening portion 64 and is likely to be clogged. As illustrated in FIG. 3B in an enlarged manner, in a case where the blade 61 is formed such that a distal end 61*a* as an end of the blade 61 contacts the inner surface of the flange member 65, toner is clogged in a wedge-shaped space formed between a blade surface of the distal end 61*a* of the blade 61 and the inner surface of the flange member 65. The clogging of toner is likely to increase from the wedge-shaped space as a starting point to the vicinity thereof.

If a toner scraper of a related art is provided to prevent toner clogging, for example, the following failure may occur in addition to the increase of the number of components. For example, unpleasant sound may be generated when a scraping member constituting the toner scraper contacts a screw. Further, there may be a failure that the bending angle of the scraping member increases with time and stable scraping is not performed.

Figure 4A:
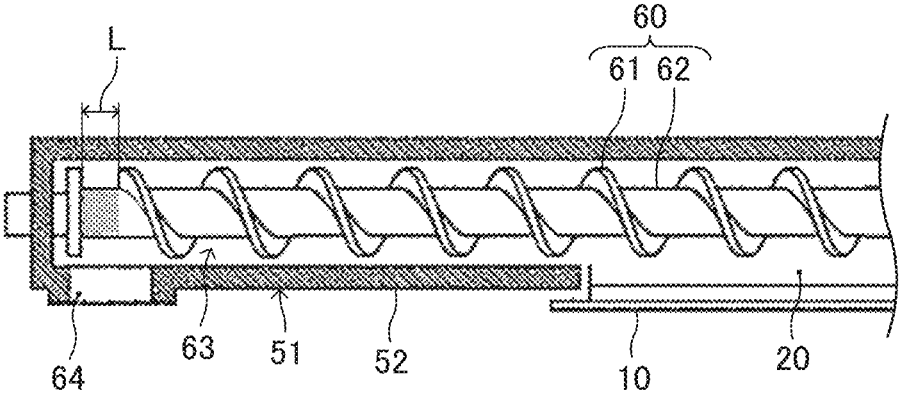
FIG. 4A is a schematic view of a main part of the belt cleaning unit.
Figure 4B:
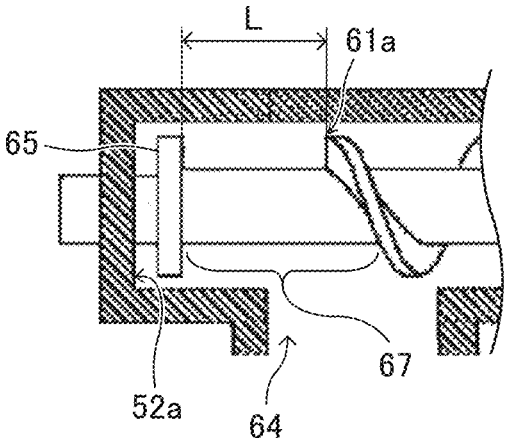
FIG. 4B is a partial enlarged view of the main part of the belt cleaning unit of FIG. 4A.

In the present embodiment, as illustrated in FIG. 4A, a gap portion 67 is formed between the distal end 61*a* of the blade 61 of the conveying screw 60 serving as a waste toner conveying screw and the inside surface of the flange member 65 by a predetermined distance L. FIG. 4B is a partially enlarged view of the left end of the belt cleaning unit 51. Thus, the occurrence of toner clogging due to the wedge-shaped space is avoided. In addition, a material having a low coefficient of friction is used for at least a surface of the gap portion 67 to lower the adhesive force of toner.

Figure 4C:
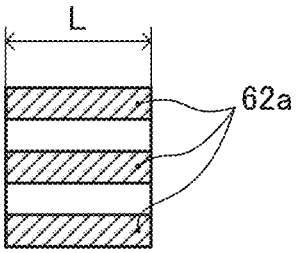
FIG. 4C is a schematic diagram illustrating a state in which a material having a low-coefficient of friction is applied on the shaft of the screw.

This configuration makes it difficult for toner to adhere to the surface of the shaft portion, thus preventing toner clogging. Examples of the material having a low coefficient of friction include fluorine compounds and silicone compounds. In a case where the entire conveying screw 60 is formed by resin molding, the material having a low coefficient of friction can be attached to the surface of the conveying screw 60 after molding by surface treatment such as coating. FIG. 4C illustrates a state in which the material having a low friction coefficient is applied to a stripe-shaped application area 62*a*. The material may be applied to the entire circumference of the conveying screw 60 in a circumferential direction or an area of another shape on the conveying screw 60.

A mold for resin molding and the inner surface of the mold need to be smoothed. Reducing the friction of the entire shaft increases cost. Reducing the friction of only a part of the mold can prevent cost increase due to processing of the inner surface of the mold. Without modifying the mold, a post-processing work for low friction later can prevent at least cost increase. By utilizing the fact that a mold release agent applied to the inner surface of the mold adheres to the surface of the molded article, a material such as TEFLON (registered trademark) having releasability and capable of adhering to the surface of the molded article to reduce friction can be used for a mold portion corresponding to the end portion of the shaft. Applying the above-described materials to the surface of the molded article can reduce the friction of the shaft portion. The friction of the entire shaft portion may be reduced.

Figure 5:
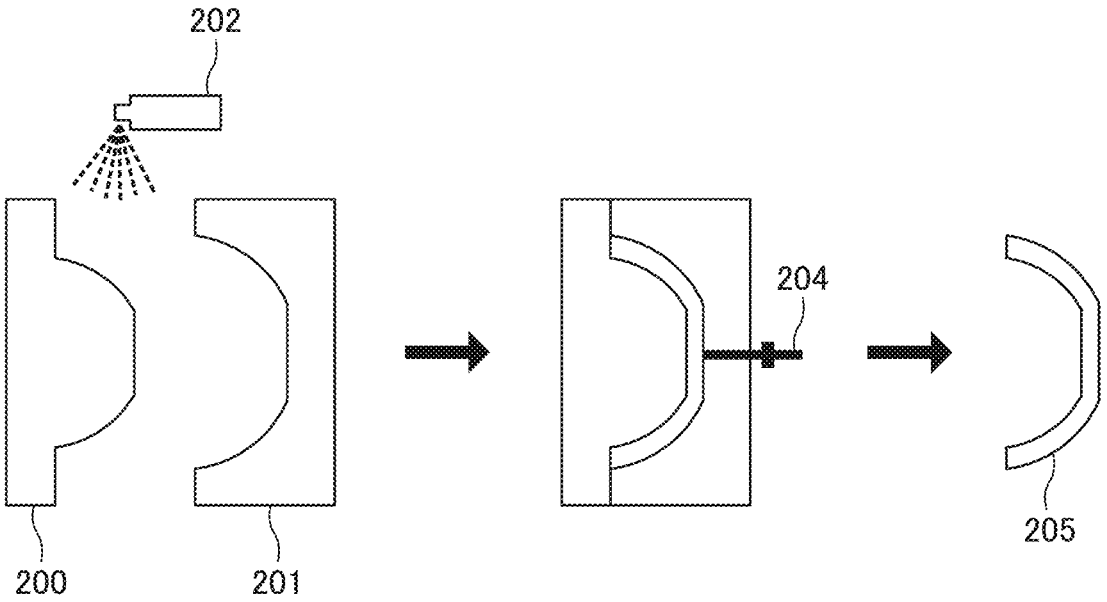
FIG. 5 is a schematic diagram illustrating an example of a resin molding method.

FIG. 5 is a schematic diagram illustrating a resin molding method according to an embodiment of the present disclosure. A material for reducing friction is applied by, for example, a spray 202 to one of molds 200 and 201 (in this example, the mold 200) corresponding to a surface to which the material capable of reducing friction is to be applied. Then, a melted resin material 204 is poured as illustrated in FIG. 5. When a molded article 205 is taken out after being cooled, the molded article 205 having the surface to which the low-friction material is transferred and adhered can be obtained.

Figure 6:
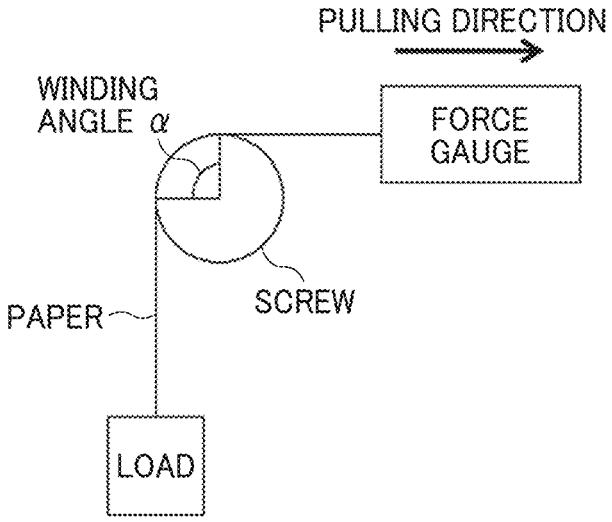
FIG. 6 is a schematic diagram illustrating a measuring method of a coefficient of friction of the screw.

A verification experiment was conducted using the waste toner conveying screw in which a friction coefficient lowering treatment was performed on the gap portion 67. The friction coefficient lowering treatment was performed by spray coating. The friction coefficient was measured by the Euler belt method illustrated in FIG. 6. The friction coefficient μ is calculated by substituting a tensile force T1, a weight load W, and a winding angle α into the Euler's formula below. In the Euler's formula, the friction coefficient $\mu=(1/\alpha)\times\ln(T1/W)$ is satisfied. The load W was 20 grams, the paper was "My Paper" (manufactured by RICOH Co., Ltd.) was cut in the width of 10 mm so that the paper fiber direction was the longitudinal direction, the winding angle α was 90°, the pulling speed of a force gauge was 1 mm/sec, and the screw was fixed so as not to rotate.

Next, the waste toner conveying screw obtained by the friction coefficient lowering treatment was attached to the Multifunction Peripheral (MFP) "RICOH MP C6004" (manufactured by RICOH Company, Ltd.) having a configuration similar to the configuration as in FIG. 1, and an image having an image area ratio of 0.5% was continuously printed at 500 prints per job by a distance corresponding to 300,000 sheets of A4 paper in the lateral direction without passing paper. After printing is completed, the presence of toner adhesion to the waste-toner conveying screw 60 was checked.

TABLE 1

| | Treatment of conveying screw | Coefficient of friction | Adhesion of waste toner |
|---|---|---|---|
| Example 1 | Without coating | 0.45 | Bad (Belt damage) |
| Example 2 | Coated with fluorine compound | 0.30 | Good |
| Example 3 | Coated with silicone-based compound | 0.28 | Good |
| Example 4 | Coated with fluorine-based compound (coated area is one third) | 0.40 | Fair |
| Example 5 | Coated with fluorine-based compound (coated area is two third) | 0.35 | Good |

Experimental results are illustrated in Table 1. The experimental results are examples of experiments in which materials for the coating process and coating areas are different. In Example 1, toner adhesion occurs on the waste-toner conveying screw 60 and caused a damage to the intermediate transfer belt 10. The reason why the intermediate transfer belt was damaged is described later. In Examples 2 and 3, the materials illustrated in Table 1 were applied to the entire circumferential surface of the range of distance L. No toner adhesion occurred in Examples 2 and 3. In Example 4, the area to be treated to lower the friction coefficient is one third. Although the growth of adhesion was observed, the belt damage and abnormal images did not occur. The denominator indicates the area of the entire circumference of the coating area of the distance L indicated in FIG. 4B. The numerator is a coated area of the above-described area of the entire circumference. In Example 5 in which the area to be treated to lower the friction coefficient is two third, no toner adhesion occurred. From the results of above-described experiments, it has been found that the friction coefficient of the gap portion is preferably 0.35 or less.

The reason why the intermediate transfer belt was damaged when the toner adhered to the conveying screw 60 is as follow. When toner clogging occurs, the conveying screw 60 is difficult to rotate. Then, the opposing roller 16 that transmits the driving force to the conveying screw 60 is difficult to rotate. The opposing roller 16 rotates together with the intermediate transfer belt 10. Accordingly, in a case where the opposing roller 16 difficult to rotate, the intermediate transfer belt 10 is difficult to rotate at a normal speed. As a result, the intermediate transfer belt 10 is wrinkled or damaged.

The above-described example illustrated in the drawings includes an intermediate transfer belt, at least one or more roller members, a cleaner that removes toner remaining on the intermediate transfer belt, and a member that conveys waste toner collected by the cleaner. The member that conveys the waste toner is a waste toner conveying screw including a shaft and a projection. Further, the above-described example includes an opening portion through which the conveyed toner falls, and a gap. The gap is formed across the circumferential direction of the shaft of the waste-toner conveying screw 60 between the projection of the waste-toner conveying screw 60 and an end of the projection of the waste-toner conveying screw 60 in an area between the projection of the waste-toner conveying screw 60 and a wall surface at a position perpendicular to the shaft of the waste-toner conveying screw 60. In this example, at least the gap portion on the shaft of the waste-toner conveying screw 60 has a friction coefficient equal to or less than the friction coefficient of a portion other than the gap portion on the shaft of the waste-toner conveying screw 60.

The above-descried configurations are examples and embodiments of the present disclosure are not limited thereto. For example, the following aspects of the present disclosure may have advantageous effects described below. Reference numerals of elements of the above-described embodiments corresponding to elements constituting aspects are appended as examples.

First Aspect

In a powder conveying device (e.g., the belt cleaning unit 51) provided with a conveying screw (e.g., the conveying screw 60), a surface portion (e.g., the gap portion 67) of a shaft (e.g., the shaft 62) at at least one of an upstream end or a downstream end of the shaft in a conveying direction in which the conveying screw conveys powder, in at least one of an inflow portion or a discharge portion (e.g., the opening portion 64) for the powder to be conveyed, has a lower friction with the powder than another surface portion of the shaft at a position other than the at least one of the upstream end or the downstream end. As described in the above-described embodiment, such a configuration can prevent powder from easily adhering to the shaft. Clogging of the powder due to adhesion of the powder can be prevented without increasing the number of components.

Second Aspect

In the above-described first aspect, the surface portion is made of a material having the lower friction with the powder than the other surface portion of the shaft. According to this configuration, material selection can prevent the powder from easily adhering to the shaft.

Third Aspect

In the above-described second aspect, the material having the lower friction is at least one of a fluorine compound or a silicone-based compound.

According to this configuration, adhesion of the powder to the shaft can be prevented using a widely distributed material.

Fourth Aspect

In the above-described first aspect to third aspect, a predetermined gap (e.g., the gap portion 67) is provided between a member (e.g., the flange member 65) having a surface perpendicular to the shaft (e.g., the shaft 62) of the conveying screw (e.g., the conveying screw 60) and an end of a blade (e.g., the blade 61) formed on the shaft at an end of the conveying screw in the conveying direction. This configuration, unlike a related art, can avoid an occurrence of a wedge-shaped space serving as a starting point of toner clogging. Note that in the example illustrated in FIG. 4B, the member having the surface perpendicular to the shaft 62 is the flange member 65. For example, the member having the surface perpendicular to the shaft 62 may be a side wall of the housing 52.

Fifth Aspect

In the above-described first aspect to fourth aspect, the surface portion (e.g., the gap portion 67) having the lower friction is at the downstream end of the shaft in the conveyance direction and faces an opening (e.g., the opening portion 64) serving as the discharge portion of a bottom surface of a case (e.g., the housing 52) defining a powder conveyance path (e.g., the powder conveyance path 63). This configuration can avoid an occurrence of toner clogging above the opening of the bottom surface at the downstream end in the conveyance direction and an interference of a free fall of the toner clogging.

Sixth Aspect

In the above-described first aspect to fifth aspect, the powder is toner. The configuration of the sixth aspect can prevent a failure caused by toner clogging.

Seventh Aspect

An image forming apparatus includes the powder conveying device (e.g., the belt cleaning unit 51) according to the above-described sixth aspect. This configuration can prevent a failure of the image forming apparatus caused by toner clogging.

Eighth Aspect

In the seventh aspect, the toner is waste toner. The degree of the lower friction is a friction coefficient of 0.35 or less. This configuration can properly prevent clogging of the waste toner.

Ninth Aspect

In the eighth aspect, the conveying screw (e.g., the conveying screw 60) conveys the waste toner and is driven by a roller (e.g., the opposing roller 16) that rotates with a belt (e.g., the intermediate transfer belt 10) used for image formation. This configuration can prevent a damage to the belt.

Tenth Aspect

In the ninth aspect, the roller (e.g., the opposing roller 16) is disposed, via the belt (e.g., the intermediate transfer belt 10), opposite a cleaning member (e.g., the belt cleaning blade 20) that cleans the belt. This configuration can prevent a damage to a belt.

Eleventh Aspect

In a powder conveying device (e.g., the belt cleaning unit 51) including a conveying screw (e.g., the conveying screw 60), at least one of a fluorine compound and a silicone-based compound is disposed on a surface portion of at least a part of a shaft in a conveying direction in which the conveying screw conveys powder. Such a configuration can prevent the powder from easily adhering to the shaft. Clogging of the powder due to adhesion of the powder can be prevented without increasing the number of components.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A powder conveying device comprising:

an inflow portion into which powder is to flow from an outside of the powder conveying device;

a discharge portion from which the powder is to flow out to the outside of the powder conveying device;

a conveying screw including a shaft and a blade, the conveying screw being configured to convey the powder from the inflow portion to the discharge portion in a conveying direction; and a flange on at least one of an upstream end or a downstream end of the shaft and extending perpendicular to the shaft with a set gap existing on a surface of the shaft between the flange and an end of the blade, the set gap having a surface spray coated with a material having a lower friction with the powder than another surface portion of the shaft at a position other than the set gap, wherein the surface of the set gap has the material applied in a plurality of stripes extending in a length direction of the shaft.

2. The powder conveying device according to claim 1, wherein the material having the lower friction is at least one of a fluorine compound or a silicone-based compound.

3. The powder conveying device according to claim 1, further comprising:

a case including the conveying screw and defining a powder conveyance path, wherein the surface portion having the lower friction is at the downstream end of the shaft in the conveying direction and faces an opening serving as the discharge portion of a bottom surface of the case.

4. The powder conveying device according to claim 1, wherein a diameter of the shaft is same across an entire length of the shaft including the set gap.

5. The powder conveying device according to claim 1, wherein the powder is toner.

6. An image forming apparatus comprising:

the powder conveying device according to claim 5.

7. The image forming apparatus according to claim 6, wherein the toner is waste toner and the surface portion has a friction coefficient of 0.35 or less with respect to the waste toner.

8. The image forming apparatus according to claim 7, further comprising:

a belt; and a roller configured to rotate with the belt in image formation, wherein the conveying screw is configured to convey the waste toner and be driven by rotation of the roller.

9. The image forming apparatus according to claim 8, further comprising:

a cleaning member configured to clean the belt, wherein the roller is disposed opposite the cleaning member via the belt.

* * * * *